United States Patent [19]

Brosenius

[11] 4,115,953

[45] Sep. 26, 1978

[54] SELF SEALING HEAT INSULATING SHUTTER SYSTEM

[75] Inventor: Karl Hilding Brosenius, Stockholm, Sweden

[73] Assignee: Tekram Associates, North Haven, Conn.

[21] Appl. No.: 814,188

[22] Filed: Jul. 11, 1977

[51] Int. Cl.[2] ..... E05D 15/26

[52] U.S. Cl. ..... 49/125; 49/409; 49/412

[58] Field of Search ..... 49/125, 409, 412, 209, 49/208; 160/196, 197, 193

[56] References Cited

U.S. PATENT DOCUMENTS

| | | | |
|---|---|---|---|
| 1,927,982 | 9/1933 | Howard | 160/193 |
| 2,850,089 | 9/1958 | Burke | 49/125 X |
| 3,628,289 | 12/1971 | Buffington et al. | 49/409 |
| 3,896,508 | 7/1975 | Doan | 49/125 X |
| 3,975,862 | 8/1976 | Doan | 49/409 |

*Primary Examiner*—Philip C. Kannan
*Attorney, Agent, or Firm*—James & Franklin

[57] ABSTRACT

The system includes a plurality of movable heat insulating shutter sections forming a barrier to produce a "dead air gap" adjacent the interior of a window and increasing the heat insulation capacity of the windows. The sections are suspended by wheels, rollers or gliding fittings from guide tracks situated above the shutters and are movable therealong between opened and closed positions. The sections are provided with vertical and horizontal friction or pressure seals which, when the sections are in the closed position, seal the sections together and to the window embracement. The tracks and the suspending fittings are formed such that the sections can be pendulum-like pivoted away from the window in order to disengage the pressure of the seals and thus facilitate movement of the sections between the open and closed positions without friction at these seals. In one embodiment, portions of the guide tracks can be pivoted in their own horizontal plane together with a suspended shutter section to accomodate recessed windows or windows situated in or near wall corners.

25 Claims, 14 Drawing Figures

21a
21
20
17
18
24
34
19
23
25
43
27
26
28
44
50
29
30
51
6
13
47
14
48
49
3
31
33
32
8
2
9
11
10
1
5
4
7
12
15
16
40
46
42
40a
41
36
37
39
38
35
53
52
22588

SELF SEALING HEAT INSULATING SHUTTER SYSTEM

The present invention relates to a heat insulating shutter system for use on the interior side of a window or the like and more particularly, to a means of suspending such a shutter system whereby the shutters form a "dead air gap" between the window and the shutter system and whereby the shutters are easily movable between opened and closed positions and, at the same time, capable of maintaining, when in the closed position, a substantially air tight seal between the air gap and the room's air in order to prevent air-circulation between the colder air in the air gap and the warmer room's air and thus provide excellent heat insulation.

Shutter system of the present invention is designed primarily to improve the heat insulating properties of windows. However, the shutters can be substituted for ordinary side curtains and for blinds to prevent light from entering a room and also to shade too strong solar heat radiation in summertime or to reduce disturbing noise from outside. The shutters are fabricated to be conveniently installed either with existing windows or with new windows as a building is being constructed.

It is known that the windows of a building have poorer heat insulating capacity than the walls thereof. For instance, an ordinary double plate glass window has a heat insulating capacity of approximately one-eighth of the heat insulating capacity of a well insulated outer wall. Windows comprising a single glass pane have even poorer heat insulating characteristics. Thus, insulating the windows of a building will substantially reduce the amount of energy to heat same.

In order to improve the heat insulating capacity of existing single glass windows it is known to apply one additional glass on the interior side of the window, by means of which an insulating "dead air gap" will be enclosed between the two window glasses. Still better insulation will be obtained if the additional window glass is replaced by double "insulating glasses". The heat insulating capacity of a window, which is improved this way, is, however, still substantially poorer than the heat insulating capacity of a modern outer wall. Besides, an improvement of the insulation of that kind at existing buildings is comparatively expensive.

Substantially greater heat insulating properties can be obtained if shutters exhibiting high insulating capacity can be mounted to the window. The shutters are designed to be closed at night and opened in the daytime; it is during the cold night time that the largest heat loss from the house take place.

However, known performances of heat insulating shutters also have a number of disadvantages, which, hitherto, have prevented a more common use of shutters. For example, shutters for use on the exterior of a window are difficult to open and close from the inside, and they are also often impossible to open or close at all, owing to snow, ice or high wind. At shutters applied to the inside of the window it is difficult to get space for the shutters when they are opened, so that they will not cause obstacles or be disturbing from the view of appearance. The shutters must also, when in closed position, air-sealing engage the wall embracement around the periphery of the window in order to prevent useless heat loss because of air circulation between warm "room's air" and colder air in the air gap between window and shutters. Such air-sealings on the other hand causes frictions at the sealings when moving the shutters, which counteracts the easy and quick moving of the shutters. Such easy handle of the shutters is a demand to get the shutters generally accepted.

The present invention avoids the disadvantages as now mentioned and has besides a number of special advantages.

It is, therefore, a prime object of the present invention to provide a heat insulating shutter system for use on a window or the like, which higly increases the heat insulating capacity of the window itself and which provides an effective air seal between the "dead air gap" between the window and the shutter system on one side and the room's air on the other side.

It is a second object of the present invention to provide a heat insulating shutter system for use on a window or the like wherein the shutter sections are easily movable so as to facilitate opening and closing of the shutter system.

It is a third object of the present invention to provide a heat insulating shutter system for use on a window or the like wherein the shutter sections are pendulum-like pivotable to release the seals and belonging frictions at moving the shutters so as to facilitate the opening and closing thereof.

It is a fourth object of the present invention to provide a heat insulating shutter system for use on a window or the like wherein the weight of the shutter sections is utilized to maintain the seal.

It is another object of the present invention to provide a heat insulating shutter system for use on a window or the like, which window is situated close to a transversal wall (a wall corner) or in a window recess, wherein the shutter sections can be pivoted (in a horizontal direction) to an opened position perpendicular to the plan of the window.

It is a further object of the present invention to provide a heat insulating shutter system for use on a window or the like wherein mounting means are provided to permit pendulum-like pivoting of the sections to disengage the pressure on the seals and thereafter sliding of the shutter sections between the open and closed positions.

It is still further object of the present invention to provide a heat insulating shutter system for use on a window or the like which can be utilized in conjunction with pre-existing window insulations without modification thereof.

It is a still further object of the present invention to provide a heat insulating shutter system for use on a window or the like wherein the system comprises relatively simple, inexpensive parts which function reliably together.

In accordance with the present invention, a heat insulating shutter system for use on a window or the like is provided including a plurality of overlapping shutter sections, guide means mounted above the window, means for movably mounting the shutter sections to the guide means and means for pressure sealing the sections to one another and to the adjacent window embracement. The mounting means comprises means for pivotally mounting each of the shutter sections to the guide means, such that the shutter sections may be pivoted from a first position, wherein the sections are substantially parallel to the plane of the window (vertical) and the sealing means are engaged and a second position, inclined with respect to the first position, wherein the sealing means are disengaged. The pivotal mounting means also permit movement of the shutter sections along the guide means between open and closed positions, when the sections are in the second position. The window "embracement" comprises vertical portions of the walls adjacent to the window on both sides of the window and further a window sill or the like at the bottom of the window and a curtain board or the like at the top of the window, this board or the like supporting the guide means for the shutters. Pressure sealing is a sealing against air circulation which sealing is affected by a certain pressure, which pressure can be very small and limited at the shutter system according to the invention.

The mounting means is designed such that it engages guide means at a point laterally displaced from the plane of the shutter section which passes through the center of gravity thereof, thereby utilizing weight of the section to cause the section to move towards the first position and thus maintaining the engagement between the pressure seals and the adjacent sections of the window embracement. Thus, the weight of the sections is effectively utilized to maintain the integrity of the seal.

The guide means comprises tracks having sections permitting mounting means to pivot with respect to said track (for example "C"- cross-sectional structures). The mounting means includes one or more rollers from which the shutter sections are mounted and which are situated within the track. The track is designed such that the rollers may be pivoted with respect thereto, thus permitting the pivoting of the section to an inclined position, wherein the pressure seals are disengaged, so as to facilitate movement of the section between the opened and closed positions.

In one embodiment, the track is divided into portions of which one or more portions are horizontally pivotally rotable mounted to a bracket, such that the rotable portion, and the shutter suspended therefrom, can be horizontally pivoted to a position substantially perpendicular to the plane of the window. This embodiment is useful when the shutters are utilized on recessed windows or windows which are adjacent a wall corner, such that it is impossible to situate the shutters in opened position flush with the wall adjacent to the window.

To these and other objects which may hereinafter appear the present invention relates to a heat insulating shutter system for use on the interior of a window or the like as recited in the annexed claims and described in the specification taken together with the accompaning drawings wherein like numerals refer to like parts in which:

Figures 1, 2, 3, 4, 4A, 5, 5A:
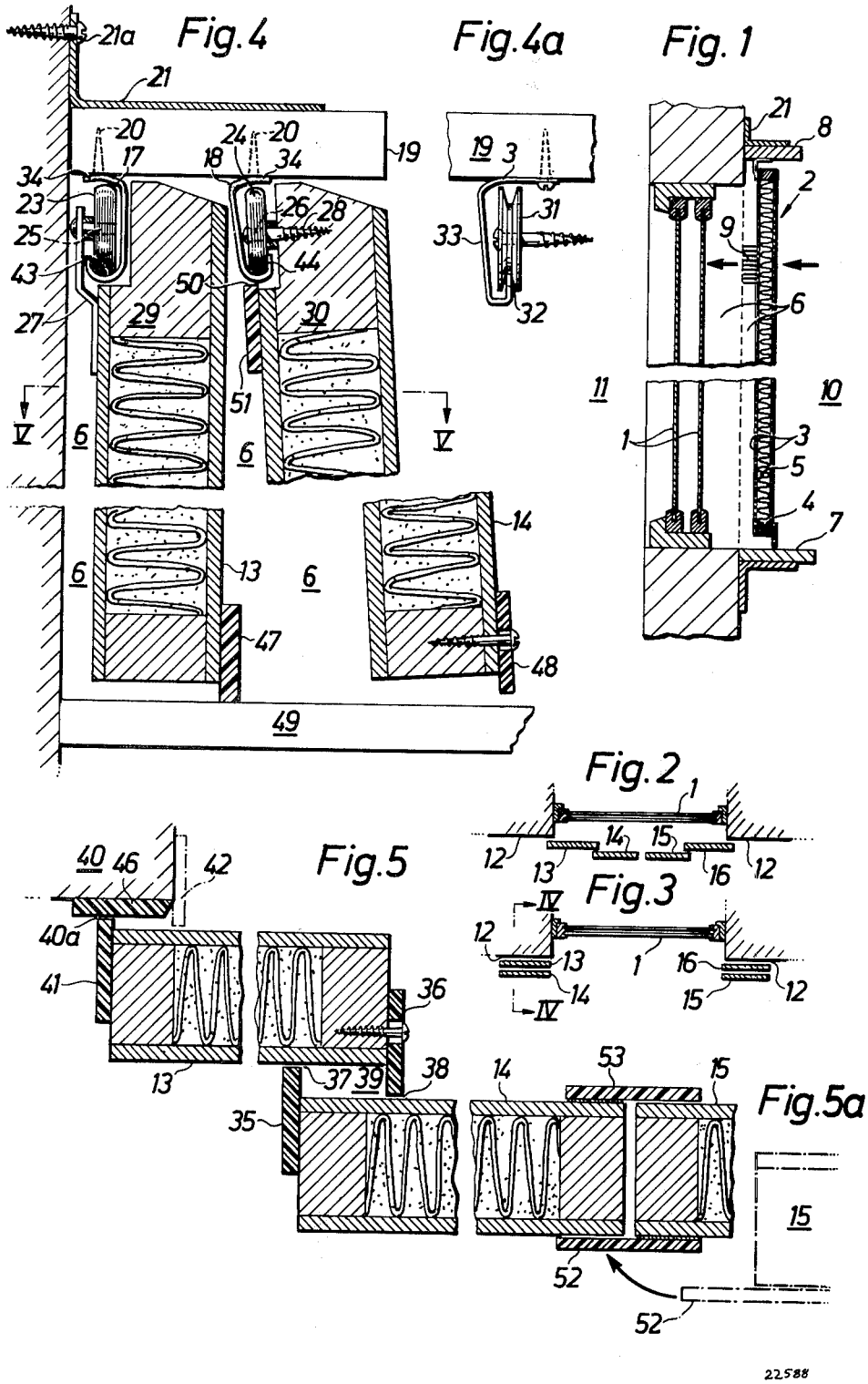
FIG. 1 shows in a vertical cross-sectional view the general principle of air-sealing of the "dead air gap" between a window and removable insulating shutters according to the invention.
FIG. 2 is a top elevational view of the shutter system of the present invention in the closed position.
FIG. 3 is a top elevational view of the shutter system of the present invention in the open position.
FIG. 4 is a vertical section view taken along line IV—IV, FIG. 3, showing one shutter in vertical and one in inclined position.
Figure 6:
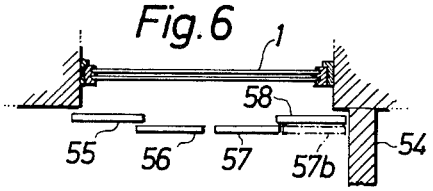
Figure 7:
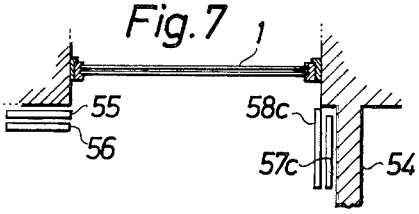
Figure 8:
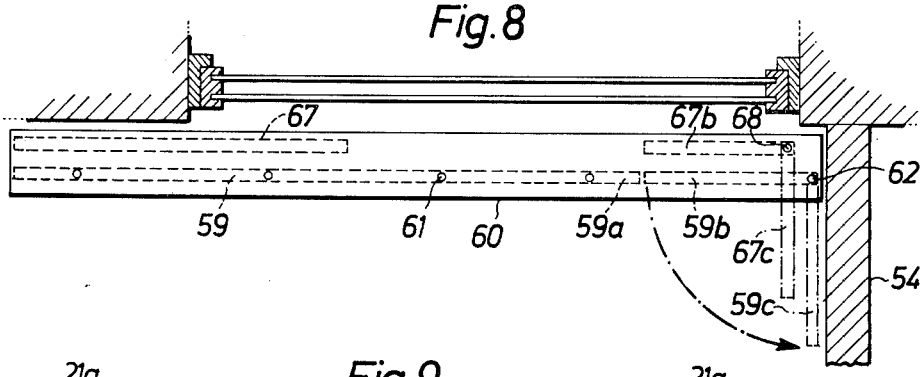
Figure 9:
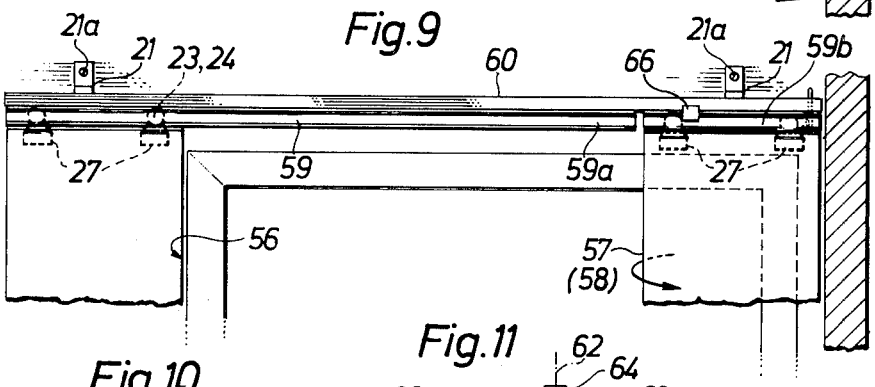
Figure 10:
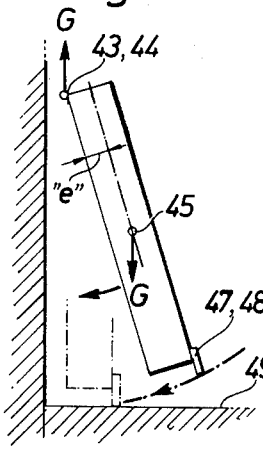
Figure 11:
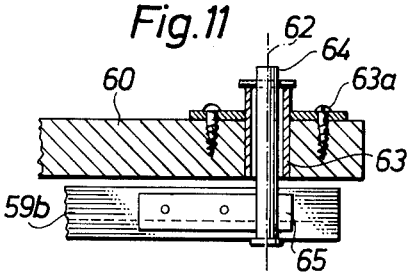
Figure 12:
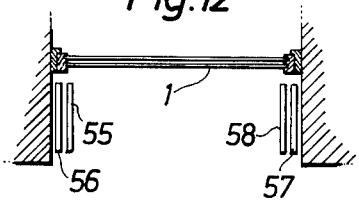
Figure 13:
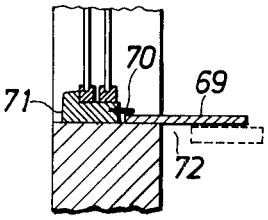

FIG. 4*a* is a vertical section view of an alternate embodiment of the track and roller (pulley) assembly;

FIG. 5 is a horizontal section view of a portion of the shutter system of the present invention taken along line V—V in FIG. 4;

FIG. 6 is a top elevational view of another embodiment of the shutter system of the present invention designed for use with a window situated close to a wall corner and showing the shutters in the closed position;

FIG. 7 is a view similar to FIG. 6 but showing the shutter system of the present invention in the opened position;

FIG. 8 is a more detailed top elevational view of the track system utilized in the embodiment shown in FIG. 6;

FIG. 9 is a front elevational view of the system shown in FIG. 8;

FIG. 10 shows schematically the principle of laterally displaced (excentrically) suspending of the shutters and the pendulum-like pivoting of the shutters with a shutter pivoted from its vertical position to an inclined position;

FIG. 11 is an enlarged view of a track pivoting means, which allows a portion of a guide track to be turned around in its own horizontal plane;

FIG. 12 is a top elevational view of an embodiment of the present invention utilizable with recessed windows; and FIG. 13 is a cross-sectional view of a portion of the window frame with a air-sealing member covering the air-gap downwards between a window and a window-sill or the like.

FIG. 1 shows a vertical section of a double plate glass window 1 mounted in a window frame which, in turn, is situated within an outer wall 12, FIG. 1. On the interior (room) side of window 1 is situated a heat insulating shutter system of the present invention (shown in closed position). The shutter system in most cases comprises four sections 13, 14, 15, 16, FIG. 2, (only one of which, 2, is visible in FIG. 1). The shutters can each be formed from a pair of thin surface layers 3, mounted on opposite sides of a slender framework 4, made of wood or other suitable material. Between surface layers 3 is situated an insulating material 5 for example plastic, mineral wool etc, which gives the shutter a high degree of heat insulation capacity. The shutters can also be performed in other manners, for example being made of plastic only.

Between window 1 and the shutter 2, FIG. 1, is situated a "dead air gap" 6, the shutter sections being sealed to a window-sill 7, extending from wall 12, by horizontal sealing members to maintain the gap at the lower portion of the window and to a curtain board 8 or the like mounted on wall 12, by the guide tracks at the upper portion of the window (not shown in FIG. 1). Along the sides of the window, the shutter sections are sealed to wall 12 by vertical sealing elements. The shutter sections thus sealingly engage wall 12, around the periphery of window 1, so as to prevent any circulation of air between gap 6 and the interior 10 of the room.

Referring to FIG. 1 one of the main principles of the invention can now be explained. When the outside temperature is low the highly insulated shutters 2 separate the air gap 6 with colder air from the heated room's warmer air 10. The air of the air gap 6 will be low bacause of the poor insulating capacity of the windows 1 and because the highly insulated shutters 2 permits very little heat to reach the gap from the warmer room. Now, according to the physical laws of heat transport through an outer wall for example a window, this heat transport is proportional to the temperature difference (temperatur descent) between both sides of the window. Consequently the lowest heat loss through the window—and then from the house—will be obtained if the temperature of the air gap 6 inside the window is low. A low temperature of the air gap will be obtained firstly if the the insulation capacity of the shutters is high, as the heat transport through the shutters from the heated room's air to the air gap 6 then will be low.

However, if temperature in air gap 6 will be low (the air will be cold), the colder air 6 will, according to physical laws, be heavier than the warmer room's air 10. That will cause an air circulation between the colder air in the gap and the warmer air in the room, if the air sealings of the gap are not perfect. At such air circulation warm room's air will penetrate the air gap and increase the temperature of the air gap. Consequently, according to physical laws mentioned above, the heat losses through the window will again increase. If the sealings between the gap and the room are ineffective, the insulating capacity of the shutters can loose most of its effect on improving the insulation of the window openings.

Perfect sealing effect of the sealings between the air gap and the room, when the shutters are in closed position, is then of greatest importance. However, according to known methods, perfect sealing mostly needs sealings of an elastic material, wherein there are a certain elastic pressure on the sealings. A known example is sliding balcony doors, which run in guide tracks upwards and downwards, the tracks being provided with elastic seals in the tracks, which seals are to a certain degree exposed to elastic pressure. However, pressure sealings of that kind cause considerable frictions when moving the movable doors, shutters etc. Such frictions is then counteracting the need to move the shutters with a minimum of inconvenience and time, if several shutters are to be moved at least twice a day.

These difficulties are effectively solved according to new principles at the invention. The necessary pressure seals are engaged only when the shutters are in closed position, but the seals are automatically disengaged when moving the shutters. This function will be explained more in detail later on.

FIG. 2 shows a top elevational view of the shutter system of the present invention in the closed position. In the embodiment shown in FIG. 2, where the window is applied in a window-opening of a wall 12, the plane (flush) portions of which extend somewhat on both sides of the window opening, the shutter system comprises four shutter sections 13, 14, 15 and 16. Above the window mounted to curtain board 19 are two parallel guide tracks 17, 18 (not shown in FIG. nr 2), FIG. 4. Shutter sections 13 and 16 are suspended from track 17 and shutter sections 14 and 15 are suspended from track 18. The shutter sections 13 through 16 are slidable along the parallelly situated tracks 17, 18 from a closed position, as shown in FIG. 2, to an open position as shown in FIG. 3, wherein section 14 covers section 13 and section 15 covers section 16, such that the sets of shutter sections are situated adjacent the surface of wall 12 at opposite sides of window 1.

In open position, FIG. 3, the shutters 13 and 14 completely cover each other and in the same way the shutters 16 and 15 cover each other. Thus the shutters according to FIG. 3 in open position cover a portion of the wall on both sides of the window, which only amounts to about one-fourth of the width of the window. This width can be further diminished, if the window opening is covered by six still narrower shutters, which overlapping each other slide suspended in three close to each other arranged parallel guide tracks. At extreme cases even can be used, in the corresponding way, four guide tracks and eight shutters, which overlap each other.

On the other hand it can be sufficient at narrow windows to use only one pair of meeting shutters, which are suspended in one guide track only, and further can shutters be "sheltered" in open position only on one side of the window opening. The invention then makes possible great variations of covering window openings with different widths. The invention also makes possible to cover a window opening, which is performed as a recessed window, FIG. 12, or to cover window openings, which are situated quite close to a transversal wall (wall corner), FIG. 7. These performances will be described later.

The surfaces of the sections in FIG. 2–3, which are visible from the room's side, can be covered by wall paper, fabrics etc., which gives the sections appearance of ordinary side curtains. Thus they can also substitute such curtains.

The sections are suspended only at the top of the sections by rollers, pulleys, small wheels or the like, which run in guide tracks situated above the shutters. Instead of rollers etc. can sometimes also be used suitable gliding fittings. The guide tracks can be performed in many different ways. FIGS. 4 and 4*a* shows three different examples of performing the guide tracks. The tracks are preferably made of bent plate, aluminium sections or the like. In the performance according to FIG. 4 the guide tracks are mounted from curtain board 19 for example by screws 20. Board 19 is secured to wall 12, above window 1, by two angle brackets 21, one at each end of the board, and the angle brackets 21 are secured to the wall by a screw 21*a*. By a kind of "lever-action" this single screw results in a very stable securing of board 19 to the wall. The erecting of the board 19 with belonging tracks and shutters is thus very quick and simple, but can of course be performed in other ways.

The tracks shown as examples in FIGS. 4 and 4*a* have all substantially "C" shaped cross-section. At the performance shown on the shutter to the left on FIG. 4, shutter 13, the shutter is provided with a pair of roller mounting brackets (or plates) 27 (only one of which is shown) each of which carries a spindle 25 to which a rotable roller 23 is mounted. Roller 23 is freely movable along the track 17. All tracks have a cross section such that the shutters can be pivoted with respect to its original (unpivoted) position, substantially parallel to the plane of window 1 (vertical), to a pivoted position wherein the shutter is inclined inwards a minor angle. As described in detail below, the pivoting of the sections serves to disengage the seals between the shutter sections mutually and the wall 12 from frictional contact in order to permit free movement of the sections along the tracks.

At the performance shown on the shutter 14 to the right on FIG. 4 the spindle for the rollers is continued with a screw-threaded part 28 into the edge 30 of the shutter 14. The track 18 is here provided with an inclined side to permit roller 24 and thus section 14 to be pivoted from its original normally vertical position to an inclined position as shown on FIG. 4.

When moving the shutters 13 and 14 sideways along the tracks 17 respectively 18 the shutter 13 is pivoted a certain angle inwards and at the same time the shutter 14 is pivoted to an extent slightly greater than section 13. By this additional degree of pivoting movement the pressure seals between sections 14 and 13 can be disengaged at the same time as the pressure seal between section 13 and the wall is disengaged, thereby permitting free movement of shutter 13 along track 17 and shutter 14 along track 18 such that movement between the closed position (as shown in FIG. 2) and the open position (as shown in FIG. 3) is facilitated.

FIG. 4*a* shows an alternate embodiment of the track and roller assembly as shown in FIG. 4. As shown in FIG. 4*a* the roller is substituted by a flanged wheel or pulley 31, which fits into the upstanding bottom 32 of a track 33, connected to a curtain board 19. Track 33 has a section to permit pivoting of wheel 31 with respect to its vertical position in a manner similar to track 18.

All performances of the tracks, 17, 18, 33, are provided with a top flange of the track, which with small margins prevent the rollers or wheels to run off the tracks but which top flange also permits the pivoting of the shutters and rollers or wheels. For that purpose the top flange preferably has a circular section with the centre for the circle in the contact point between the rollers (wheels) and the bottom of the tracks.

The track and roller assemblies for sections 15 and 16 are identical to those showing in FIG. 4.

The shutter sections 13 through 16 are provided with "friction engaging type" pressure seals including horizontal sealing members and vertical sealing members. With "friction engaging type" of seals means, that a shutter section provided with said type of seal will cause friction resistance if the shutter is moved with the seal still engaged. With "pressure seals" means, as mentioned earlier, that the seals are affected by a certain pressure, for example by the horizontal pressure which is affected by excentric suspending of the shutters, see below. Such pressure can also be achieved by manual actions and thereafter maintained by aid of friction, see below.

As shown in FIG. 4, the horizontal sealing members 47, 48 comprise strips of rigid material mounted on the lower surface of each of the shutter sections 13, 14 such that the edge thereof extends below the bottom of the shutter section and into frictional engagement with the upper surface of window-sill 49, when the sections are in the position substantially vertical. Horizontal sealing members 47, 48 are preferably connected to the surface of the shutter sections by means of screws as shown at 48, which extends through a vertically elongated slot (shown only in the member 48) such that the members 47, 48 are position adjustable with respect to the shutters in a conventional manner as described in detail below.

Pivoting the shutters away from the window causes the bottom edge of members 47, 48 to disengage sill 49 (as shown at 48) such that the shutter sections can be moved along tracks between the open and closed positions thereof and without friction between members 47, 48 and their counterparts the sill 49.

At pivoting return of the shutters to vertical position after finished movement sideways the seals 47, 48 again are brought to contact with the window-sill 49 with a corresponding friction in the contact surface.

This friction contributes additionally—in addition to the effect of the excentric suspending of the shutters, see below—to stabilize, "lock", the shutter in the vertical position. This is of great importance. All shutters then are stabilized in a vertical and stable position also by the friction in the contact between the bottom-edge seals 47, 48 and the window-sill 49, and that without any disturbing support arrangements, guide tracks or the like on the window-sill. The window-sill then remains free from all disturbing tracks, fittings or the like, which makes the total system more economic, improves the appearance and the cleaning etc. In spite of the fact that the pendulum-pivoting suspended shutters not are supported at the window-sill in the pivoting direction, the shutters obtain such lateral stability by especially the sealing friction between the sealing members 47, 48 and the window-sill, that they easely withstand wind-pressure, which at untight windows causes "window-draught". The shutters therefore also have the effect to effectively counteract such window-draught.

It should be especially observed, that it is a very important advantage of the invention, that the window-sill or the like is quite free from tracks and other fittings.

Also provided are horizontal sealing members adjustably mounted on the top of the shutters. One example of such sealings is shown as member 51, FIG. 4, immediately below track 18. Member 51 serves to seal shutter section 14 to track 18 and thus create a seal between curtain board 19 and the shutter section 14. Members similar to sealing members 47, 48 are situated on the other sections 15, 16 and members of type 51 on other sections of type 14.

The vertical sealing elements are best seen in FIG. 5. As shown in FIG. 5 the outer vertical edge of shutter section 13 is provided with a vertical sealing element 41, which is strip of rigid material, similar to horizontal sealing member 47, affixed to the section in a position adjustable fashion. The inside edge of vertical sealing element 41 frictionally engages the surface of wall 12 (40) or the surface of a wall lining 46 mounted on the surface of wall 12, if desired, when the shutter is in the closed position (as shown in FIG. 2) in order to seal the entire vertical edge of shutter 13 to wall 12. A similar vertical sealing element 42 may be situated on wall 12 extending toward the surface of section 13 to create an additional seal along the edge of the shutter section.

On the opposite edge of shutter 13 is provided another vertical sealing member 36, a portion of which extends forward and frictionally engages the surface of the adjacent overlapping shutter section 14. Vertical sealing element 36 is position adjustable so as to assure frictional engagement between the edge thereof and the surface of shutter 14.

On the outer edge of shutter 14 is situated another position adjustable vertical sealing element 35. Element 35 extends inwardly towards shutter section 13 and the edge thereof is in frictional engagement with the surface of shutter 13. In this manner, when the shutter sections are in closed position (as shown in FIG. 2 and FIG. 5) vertical sealing elements 36 and 35 maintain a sealing engagement along the entire vertical dimension between the adjacent shutters 13 and 14. It should be noted that shutter sections 13 and 14, when they are in the pivoted position can be moved from the closed position (as shown in FIG. 2) to the open position (as shown in FIG. 3) without frictional obstruction from the vertical sealing elements 41, 42, 36 and 35. Similar vertical sealing elements are situated in sections 15 and 16.

It should also be noted that in this case two sealing-contacts are obtained, which are independent of each other, one sealing-point at 37 and one at 38, FIG. 5. Between these two sealing points 37 and 38 a heat-insulating air-space 39, FIG. 5, is achieved. It is to be noted, that the horizontal distance between the two sealing-points 37 and 38 can be varied considerably without affecting the sealing-effect. This extra-effect of the principle of the sealing device according to the invention—it is the distance between the edge-sealings 35, 36 of the shutters can be varied—facilitates the use of a small member of standardized widths of shutters to cover windows having very different widths. It is often only needed to vary the distance 37-38 in FIG. 5.

In order to get the seals according to the invention to function well it is important, that the sealings strips after the erection of the complete shutter-system are adjusted from the beginning to be in an exact contact towards their contact-surfaces. For that purpose all sealing strips 35, 36, 47, 48, 51 are attached to the shutters with screws, which pass through elongated slots in the seal strips. Such slots with its screw is shown in FIGS. 4–5 at the seals 48 and 36. The strips can then—when the shutters are in closed position—simply be adjusted to be in exact contact towards the corresponding contact surfaces before they are locked in their final positions by tightening the screws.

The edge of shutter 14, which abuts the edge of shutter 15 when the shutters are in closed position, FIG. 5, is provided with a fixed vertical sealing element 53, which overlaps the edge of shutter section 15. In a similar manner (as shown in phantom in FIG. 5*a*) shutter 15 is provided with a fixed vertical sealing element 52, which overlaps the edge of shutter 14 when shutters are in closed position. As a result, the vertical slit between shutter sections 14 and 15 is sealed very effectively. It may be noted that this sealing point by using a suitable pivoting of the two meeting shutters 14 and 15 can be sealed at a fraction of a second and without need of any closing fittings between the two meeting shutters.

It will now be appreciated that the shutter sections 13 through 16, when in the closed, unpivoted position, will form an airtight seal with each other, with the adjacent wall 12 (40), with the window sill 49 and with the curtain board or the like 19, such that a "dead air gap" is formed inside said boundaries of the air gap. Since no essential air circulation can now occur between the air gap and the room's air, the shutter system will increase the insulation capacity of the window with the insulation capacity of the dead air gap and with its own insulation capacity. As the last mentioned insulating capacity can be conveniently made several times larger than the insulation capacity of the window, it is possible to increase the total insulation capacity of window + shutter system to a great extent. That means on the other hand, that the great heat losses through windows of a building can be considerably diminished by installing the efficient heat insulating barrier which is achieved through the shutter system.

This airtight insulating barrier can, however, according to the invention, at a fraction of a second been opened and later again closed. In order to move the shutter sections from the closed position to the open position, the shutter sections are at first manually pivoted, such that the horizontal sealing members 47, 48 are disengaged from windsill 49 and the vertical sealing elements 41 (42) are disengaged from the wall 12 (or wall lining 46). In this manner the shutter sections are no longer in the sealing engagement with the wall and windowsill. Shutter sections 14 and 15 are pivoted to a slightly greater degree than shutter sections 13 and 16, such that the vertical sealing elements 36, 35, 53 and 52 are respectively disengaged from the surface of the adjacent shutter sections, and as a result, the shutter sections can freely and without sealing frictions be moved along tracks 17 and 18 to the opened position, as shown in FIG. 3.

Thus, the shutter system of the present invention provides an air tight seal when same is in the closed, unpivoted position but is easely movable to the open position (and back to the closed position) after the shutter sections have been pivoted. In this manner, the shutter system of the present invention provides excellent heat insulating characteristics as well as an easely openable shutter system, which at the same time is pleasant in appearance and does not form at any obstruction within the room.

Another important aspect of the invention is that the weight of the shutter section is utilized in order to maintain the shutter sections in the non-pivoted position and thus maintain the integrity of the seals between the shutter sections and the wall. The manner in which this is achieved is illustrated schematically in FIG. 10. FIG. 10 shows an end view of one of the shutter sections, for example 13 (or 14). The center of gravity of the sections is noted at point 45. The point at which roller 23 contacts track 17 (which is the pivot point) is designated as 43 (and the corresponding point of shutter 14 as 44). It should be noted that pivot point 43 is laterally displaced from a plane parallel to the surface of the shutter and passing through the center of gravity 45 thereof (the shutter is then excentrically suspended). With this configuration, the weight of sections 13 (14) will result in a "bending moment" which will tend to cause section 13 (14) to move from the pivoted position, as shown in solid in this figure, to the unpivoted position, as shown in phantom in this figure, thereby causing horizontal sealing members 47 (48) to frictionally engage windowsill 49 and the vertical sealing elements (not shown) to respectively engage the shutters adjacent thereto or the wall. Thus, the weight of each of the shutter sections is utilized effectively to maintain the sealing elements and members in frictional pressure sealing engagement with the approriate surfaces, such that the integrity of the air seal is always maintained when the sections are in the unpivoted position.

The size of the horizontal pressure at the seals is decided by the excentrcity "*e*", FIG. 10, (between the suspension point of the shutters and their gravity centre) and of the weight G of the shutters. It is then interesting, that the shutters, as a result of the excentrically suspension, quite automatically return to their stable vertical position after they have been moved sideways without sealing friction due to the pendulum-pivoting inwards.

According to a special performance of the invention the insulating shutters are applicable also at window-arrangements, where there is no space on one or both sides of the window opening for sheltering the shutters in open position, for example when a window is placed immediately close to or very near a transversal inner-wall or is arranged as a recessed window. FIGS. 6–7 shows an ecample of the first case, wherein is a transversal wall 54 immediately to the right of the window-opening.

It is assumed in that example, that the window 1 is covered in closed position by four window-shutters 55, 56, 57, 58, FIG. 6, which slide suspended in two parallel guide tracks, but the type of performance is applicable also at use of one or three guide tracks. FIG. 6 is a top elevational view of the shutters in closed position, FIG. 7 the same shutters in open position. In FIG. 7 the two shutters 55, 56 to the left have been moved flush along the outer wall to a position immediately to the left of the window opening, then in principle in the same way as the performance earlier described according to FIGS. 2–3.

The two shutters 57, 58 to the right have, however, been moved to quite another position, 57*c*, 58 *c*, that is perpendicular to their original position and close to the transversal wall, FIG. 7. The shutters then leave the whole window opening free. In order to arrive to this position from closed to open position, the "inner" shutter 57 to the right (the shutter nearest the room) at first is to be moved in two steps. At a first step the shutter 57 is moved parallel to the window (or wall) until the shutter reaches the transversal wall, position 57*b*, shown in phantom in FIG. 6. At a second step (but with the same handgrip) the shutter 57 is turned (rotated) 90° in immediate run of the first step into position 57*c*, FIG. 7. Finally also the "outer" shutter 58 to the right (nearest the window) is turned 90° close to the shutter 57 and parallel to the transversal wall, FIG. 7.

The seemingly rather complicated moving and turning according to the invention of the shutters 57, 58 in this example is effected by a special arrangement of guide tracks 59 and 67, FIGS. 8–9. FIG. 8 shows a top elevational view of the curtain top board 60 (corresponding to the board 19 in FIG. 4) In FIG. 8 are, with dotted lines, shown the guide tracks, which are applied at the underneath-side of the curtain board 60 (corresponding to the guide tracks 17, 18 in FIG. 4). FIG. 9 shows an elevational view of the same top-board with its guide tracks 59 (67) and some portions of the shutters 56, 57, which are suspended by the tracks.

According to FIGS. 8–9 the inner guide track 59 is divided into two parts, one part 59*a*, FIG. 8, which is firmly connected to the top board 60 (for example affixed to the board by aid of screws 61), and one part 59*b*, which is pivotally (horizontally rotatory) mounted in relation to the top board 60. The length of the last part of the guide track corresponds to the approximate width of the shutter 57.

The guide track portion 59*b* is thus turnable in its own horizontal plane around a pivotal connection 62, FIG. 8. FIG. 11 illustrates a typical such pivotal connection. Curtain board 60 is provided with an aperture through which a collar 63 is situated. Collar 63 is connected to a bracket 63*a*, which is secured to the top of curtain board 60. A spindle or shaft 64 extends through collar 63 and is connected to the guide track part 59*b* by aid of a reinforcing and connecting fitting 65. Thus the guide track 59*b* can be turned around (rotated) for example 90° around its turning centre (rotating centre) 62 but stay in its own horizontal plane during the whole turning movement. The pivotal connection 62 can, however, be made in several other ways, but the rotatory principle will be the same.

In one of the extreme positions 59*c*, FIG. 8, of the guide track 59*b*, the guide track will protrude out into the room perpendicularly to the top board 60. In the other extreme position the guide track will stay in its primary position 59*b* immediately below the top board 60. In the last case the turnable part 59*b* of the guide track will form a continuation of the firmly affixed part 59*a* of the guide track, which will allow the suspending rollers 23 (24), FIG. 4, easely to pass all way 59*a*–59*b* or the opposite, FIG. 8. A suitable stop member 66, FIG. 9 at the underneath side of the board 60 facilitates an exact adapting of the turnable guide track part 59*b* in the elongation of the fixed part 59*a*.

Also the right part 67*b* of the "outer" guide track 67 can be turnable arranged in the same way around a turning (rotating) centre 68, FIG. 8, which preferably is situated so, that the two guide track parts 59*b* and 67*b* can be turned 90° into the positions 59*c*, 67*c* without disturbing one another, FIG. 8.

The shutters 57 (and 58) are during the turning movement as described above all the time hanging under and suspended by the turnable guide track parts 59*b* (respectively the part 67*b*) as shown in FIG. 9. The shutter 57 will then at first be moved from the closed position 57, FIG. 6, to the position 57*b*, FIG. 6, (shown in phantom), by moving the shutter parallel to the wall. When the shutter has reached the position 57*b*, FIG. 6, it is turned (rotated) for example 90° (if the transversal wall 54 is directed 90° to the outer wall) to the position 57*c*, parallel to the transversal wall, FIG. 7. Both these movements can be made with one and the same handgrip—the grip occurs at the shutter itself, which shutter forces the turnable track part 59*b* to follow the movement of the shutter. The combined sliding and turning movement can in practice occur practically as quick and convenient as would a movement only sideways parallel to the wall.

In order to accomodate a recessed window, as shown in FIG. 12, the second embodiment of the present invention is modified by making the track sections on both sides of the window horizontally pivotable (turnable). In this situation it is preferable to have the track 59 divided into three portions, the two outer portions being pivotably mounted in the manner described with respect to portion 59*b* above, and the center portion being fixedly mounted to curtain board 60. Thus, the outer pivotal portions of track 59 will each be as long as the width of a single shutter section. In this manner, in the open position, both sets of shutter sections can be moved to a position perpendicular to the plane of window 1 and thus abutting the surface of the wall adjacent the recessed window, as illustrated in FIG. 12.

The invention is thus applicable at most locations of a window. At very wide windows, however, it can be necessary to accept that the outmost side parts of the window must be covered by the width of one section of the shutters also in opened position.

All windows are not provided with a window-sill, window-bench board or the like as shown at 49, FIG. 4. According to the invention an air-sealing limit downwards of the air gap between window and shutters can be effected also at windows without such window-bench board or the like.

One example of such a performance is shown in FIG. 13, showing the lower part of a window. According to this performance a thin removable plate 69 of suitable material is arranged, which plate is pushed in under two screws or pins 70, applied in the bottom frame of the window 71 according to FIG. 13. Such a plate is preferably made of heat-insulating material of pleasing appearance, for example as a plate of thin painted board of fibre material. Such a plate can be applied also if there is a window-bench, which is arranged with an interspace 72, FIG. 13, between the window bench-board and the outer wall. This interspace must be covered by an air-sealing plate, for example as shown in FIG. 13.

A principally different but important example is shown with dotted lines at the bottom of shutter section 13, FIG. 4. It should be presumed here that the window sill or the like 49 is "non-existing". The shutter 13 is instead elongated downwards to the position 72 with the bottom edge of the shutter being situated below the bottom 73 of the window opening. Between the bottom edge of the shutter 13 and the plain part of the wall below the window opening (or a lining covering that part of the wall) is provided a sealing member 47*a*, which is affixed to the bottom edge of the shutter. The sealing member 47*a* is as a pressure sealing engaged to the plain wall surface, when the shutter is in closed position. Thus, the sealing member 47*a* will air-sealingly limit the air gap 6 downwards between window and shutters.

The sealing member 47*a* is preferably performed according to the same principles as the members 47 (48) in FIG. 4, but being affixed position adjustable to the bottom edge of the shutter instead of being affixed to the side surface as 47 in FIG. 4. Consequently, the sealing member 47*a* extends from the shutter in a horizontal direction instead of member 47 extending in a vertical direction.

The sealing member 47*a* will be disengaged from its sealing contact surface at the same principles as described above, when the shutters are pivoted away from the window. Similar sealing elements are situated at shutter 16 and principally also at shutters 14 and 15.

It is to be noted, that the (horizontal) width of sealing member 47 a will be somewhat different at shutters 13 and 16 or shutters 14 and 15, FIG. 4, as the horizontal distance between the edges of the shutters and the wall 12 is somewhat different for these two groups of shutters. This difference, however, causes no difficulties, but the sealing members (and the corresponding edges of the shutters) must be situated at somewhat different levels, which will make them to pass each other when opening or closing the shutters.

It will also be noted, that the sealing pressure between the members 47*a* and the wall here is only caused by the horizontal pressure of the weight of the excentrically suspended shutter, not by friction forces against the window sill as in FIG. 4. In order to withstand for example wind pressures (wind-draught) during windy days it is in this case suitable to arrange fittings, which manually will keep the bottom part 72 of the elongated shutters pressed against the wall 12. Such fittings are, however, not shown in FIG. 4.

The present invention has many remarkable advantages. Primarily it improves substantially the heat insulating properties of windows, and thus reduces the great heat losses of the same. In closed position the shutter sections form together a heat insulating barrier, which is substantially air tight sealing a "dead air gap" between the shutters and the window. By an easely performed pivoting of the shutter sections the air seals and corresponding frictions are disengaged, and the shutters can be moved between the open and closed positions in a quick effortless maneuver.

In open position, according to the invention, the shutters only cover a limited width of the walls on both sides of the window. Thus the shutters can be utilized instead of curtains or be hidden behind conventional curtains as desired. The shutters can be given the appearance of curtains by covering same by suitable cloth or wallpapper or the like, then also saving the costs for conventional curtains. It should also be noted, that the shutter system can be used at most types of windows, including windows close to wall corners and recessed windows.

The shutter sections can replace conventional rollers or venetian blinds, when desired, as well as to substantially reduce noise from the outside. The shutters are by their "frictions-free" manoeuvre considerably more comfortable and faster in use than the conventional roller blinds and other arrangements to shut out light. In summer-time the shutters can be used very effectively to prevent disturbing solar heat radiation.

The shutter system including tracks, preferably affixed to curtain boards, is easy to erect both in existing and new buildings—two screws will often be enough for mounting a complete window shutter system! The invention is applicable both at 2-glass-windows and 1-glass-windows.

An important advantage is that window sills or the like will be quite free from supporting guide tracks or other fittings, which are disturbing from view of appearance and for other reasons. It is also important, that window sills or the like are not necessary at all to support the shutters system; the principle of suspending the shutters pivotally at the top of the shutters thus has many advantages.

While only a limited number of preferred embodiments of the present invention have been described herein, it is obvious that many variations and modifications could be made thereto. It is intended to cover all of these variations and modifications to fall within the scope of present invention as defined by the following claims.

I claim:

1. A heat insulating shutter system for use on a window or the like comprising a plurality of insulating shutter sections, guide means mounted above said shutters, means for movably mounting said sections to said guide means and means for air sealing the space between the window and the shutter sections, said mounting means comprising means for pivotally mounting said sections to said guide means, such that said sections may be pivoted from a first position, wherein said sections are substantially parallel to the window and said sealing means are engaged, and a second position, inclined inwards with respect to said first position, and wherein said sealing means are disengaged, said pivotal mounting means permitting movement of said sections along said guide means between opened and closed positions, when said sections are in said second position.

2. The system of claim 1 wherein said guide means comprises a track and said mounting means comprises rollers, wheels or gliding fittings connected to one of said sections and situated on said track.

3. The system of claim 2 wherein said track is suspended to a curtain board or the like above the shutters, said curtain board being secured to the wall above the window by suitable fittings.

4. The system of claim 2 wherein said track has a cross section, which permits said rollers, wheels or gliding fittings to pivot with respect to said track.

5. The system of claim 1 wherein said sealing means comprises means for air sealing said sections along the vertical edges thereof and means for air sealing said sections along the horizontal edges thereof.

6. The system of claim 5 wherein said vertical sealing means comprises a sealing element mounted to and extending from one section and being in frictional engagement with the surface of an adjacent section or of the wall adjacent the window, when said section is in said first position, said sealing element being disengaged from said surface or wall when said section is in said second position.

7. The system of claim 6 wherein said sealing element extends in a direction substantially perpendicular to the surface of said section.

8. The system of claim 5 wherein said horizontal sealing means comprises a sealing member mounted to and extending from one of said sections and being in frictional engagement with the windowsill or the like, when said section is in said first position, said sealing members being disengaged from said windowsill or the like when said section is in said second position.

9. The system of claim 8 wherein said member extends in a direction substantially parallel to the surface of said section.

10. The system of claim 6 further comprising means for adjustably positioning said elements with respect to said section.

11. The system of claim 8 further comprising means for adjustably positioning said members with respect to said section.

12. The system of claim 2 wherein the point where said roller etc. rests on said track is a pivot point, and wherein said pivot point is laterally displaced from plane parallel to the surface of said section in which the center of gravity of said section is situated.

13. The system of claim 1 wherein the weight of said sections tends to pivot same towards said first position.

14. The system of claim 1 wherein the weight of said sections tends to maintain the integrity of said sealing means.

15. The system of claim 2 wherein said track is divided by a joint in a first and a second track portions, together forming a continuous track, said first portion being firmly affixed to a curtain board or the like supporting said track, said second portion being approximately equal in length to the width of a shutter section and pivotally mounted to said supporting curtain board or the like, such that said portion, and a shutter section suspended thereof, can be pivoted in its own horizontal plane between a first direction, substantially parallel to the plane of the window and a second direction at an angle with respect to said first direction.

16. The system of claim 2 wherein said track is divided by two joints in a first, a second and a third portions, together forming a continuous track, said second portion being firmly affixed to a curtain board or the like supporting said track, said first and third portions being approximately equal in length to the width of a shutter section and being situated at the both ends of the track, such first and third portions being pivotally mounted to said supporting curtain board or the like, such that said portions, and the shutter sections suspended thereof, can be pivoted in their own horizontal plane between a first direction, substantially parallel to the plane of the window and second directions at angles with respect to said first direction.

17. The system of claim 5 wherein the window opening is lacking window sills or the like and wherein said horizontal air sealing means comprises a sealing member mounted to and extending in a horizontal direction perpendicular to the surface of said shutter section from the bottom edge of said shutter section and being in sealing engagement with a wall surface or wall lining below the window opening, when said shutter section is in said first position, said sealing member being disengaged from said wall surface when said shutter section is in said second position.

18. A heat insulating shutter system for use on a window or the like, comprising a plurality of insulating shutter sections, guide means mounted above said shutters and means for mounting said sections to said guide means for movement in first and second directions, said mounting means comprising means for permitting movement in a first direction between a first position, substantially parallel to the plane of said window, wherein said sealing means are engaged and a second position, inclined with respect to said first position, wherein said sealing means are disengaged and means for permitting movement in a second direction, between a closed position, wherein said sections are situated in front of the window and an opened position wherein said sections are remote from the window, when said sections are in said second position, and wherein said sections are operably connected to said mounting means at a point laterally displaced from a plane substantially parallel to the surface of said sections and passing through the center of gravity thereof, such that the weight of said sections tend to move same towards said first position.

19. The system of claim 18 wherein said means for permitting movement in a first direction comprises means for permitting said sections to be pivoted relative to said guide means.

20. The system of claim 19 wherein said sections can be pivoted relative to said guide means to different degrees whereby adjacent sections may be separated to disengage the sealing means therebetween.

21. The system of claim 18 wherein said sealing means comprises means for sealing said sections along the vertical edges thereof and means for sealing said sections along the horizontal edges thereof.

22. The system of claim 21 wherein said vertical sealing means comprises a sealing element mounted to and extending from one section and being in frictional engagement with the surface of an adjacent section or of the wall adjacent the window, when said section is in said first position.

23. The system of claim 22 wherein said element extends in a direction substantially perpendicular to the surface of said section.

24. The system of claim 21 wherein said horizontal sealing means comprises a sealing member mounted to and extending from one of said sections and being in frictional engagement with the windowsill or the like, when said section is in said first position.

25. The system of claim 24 wherein said member extends in a direction substantially parallel to the surface of said section.

* * * * *